US005412280A

United States Patent [19]

Scott et al.

[11] Patent Number: 5,412,280

[45] Date of Patent: May 2, 1995

[54] ELECTRODELESS LAMP WITH EXTERNAL CONDUCTIVE COATING

[75] Inventors: Curtis E. Scott, Mentor; Vito J. Arsena, Highland Heights; Spiro Vamvakas, Rocky River; Joseph C. Oberle, Chagrin Falls, all of Ohio

[73] Assignee: General Electric Company, Schenectady, N.Y.

[21] Appl. No.: 228,849

[22] Filed: Apr. 18, 1994

[51] Int. Cl.[6] ..... H01J 65/00; H01J 65/04

[52] U.S. Cl. ..... 313/573; 313/493; 313/607; 313/635; 313/234; 315/248; 315/344; 315/85

[58] Field of Search ..... 313/492, 573, 234, 635, 313/607, 493, 313, 634; 315/248, 344, 39, 85

[56] References Cited

U.S. PATENT DOCUMENTS

| | | | |
|---|---|---|---|
| 4,010,400 | 3/1977 | Hollister | 315/39 |
| 4,922,157 | 5/1990 | Van Engen et al. | 315/39 |
| 5,309,058 | 5/1994 | Heindl et al. | 313/607 |

*Primary Examiner*—Donald J. Yusko
*Assistant Examiner*—Nimesh D. Patel
*Attorney, Agent, or Firm*—George E. Hawranko; Stanley C. Corwin

[57] ABSTRACT

Disclosed is an electrodeless, low pressure gas discharge lamp. The lamp includes a vitreous envelope containing a metal vapor and an inert gas. The envelope is shaped with an external chamber for receiving an electrical excitation circuit. The excitation circuit is effective for exciting the metal vapor to emit light with electromagnetic fields that are passed through the vitreous envelope from outside, to inside, the envelope. A circuit supplies electrical power from power mains to the excitation circuit. A transparent, electrically conductive coating is disposed on the inner surface of the vitreous envelope for suppressing electromagnetic interference on the power mains. An electrically conductive coating is disposed on the outer surface of the vitreous envelope; it is capacitively coupled to the inner conductive coating, via a wall of the vitreous envelope, and is maintained at a suitable potential for suppressing electromagnetic interference on the power mains. The outer conductive coating comprises a matrix of a contiguous, inorganic, glass layer bonded to an exterior surface of the vitreous envelope, and conductive particles embedded in the matrix in a sufficiently dense manner to form a conductive coating.

7 Claims, 2 Drawing Sheets

ELECTRODELESS LAMP WITH EXTERNAL CONDUCTIVE COATING

FIELD OF THE INVENTION

The present invention relates to an electrodeless lamp that employs an external conductive coating on a vitreous envelope for suppressing electromagnetic interference on mains that supply power to the lamp, and more particularly to the formation of the external conductive coating.

BACKGROUND OF THE INVENTION

An electrodeless, low pressure (e.g. fluorescent) lamp incorporates a hermetically sealed vitreous envelope that typically contains a metal vapor and a rare gas. The envelope has an external chamber into which an excitation coil is received. The excitation coil electrically excites the metal vapor in the vitreous envelope to emit light by passing a high frequency electromagnetic field through the vitreous envelope; without any electrodes within the envelope itself, the lamp is electrodeless. The high frequency electromagnetic field, however, can create undesirable electromagnetic interference (EMI) on the mains, or power lines, that supply electric power to the lamp.

To reduce such EMI to an acceptable level, the prior art has taught the use of a transparent, conductive coating on the interior of the envelope for suppressing the EMI. A cooperating, conductive coating on the exterior surface of the vitreous envelope is used to capacitively couple the inner conductive coating to a circuit potential that is suitable for suppressing EMI on the power mains. Being located on the exterior surface of the vitreous envelope, however, the outer conductive coating is susceptible to damage through any of physical abrasion, reaction with chemicals in the vitreous envelope, or reaction with chemicals in the external environment (e.g. $H_2O$ present in humidity). For instance, vacuum-deposited aluminum has been found by the present inventors to adversely react with a vitreous envelope formed of soda-lime-silicate glass, losing its structural integrity. The soda-lime-silicate glass is desirable for the vitreous envelope due to its low cost. Additionally, the outer conductive coating must be temperature tolerant, and be able to withstand thermal shocks and thermal cycling, such as occur during lamp operation.

Briefly, a suitable, EMI-suppressing, outer conductive coating should, over the expected life of a lamp, retain adequate electrical conductivity and provide appropriate capacitive coupling with the inner, transparent, conductive coating mentioned above. To assess such durability of the conductive coating, the present inventors have subjected a large number of coatings to durability tests measuring the following factors: (1) resistance to abrasion; (2) resistance to a humid environment; (3) temperature tolerance (e.g. 160° C.); and (4) resistance to thermal shock and thermal cycling. Most coatings that were tested failed to meet the foregoing durability criteria. The present invention is directed to coatings that meet the durability criteria.

OBJECTS AND SUMMARY OF THE INVENTION

Accordingly, an object of the present invention is to provide an electrodeless lamp with an outer, EMI-suppressing conductive coating that is highly durable.

An object of a specific embodiment of the invention is to provide an electrodeless lamp of the foregoing type that incorporates a vitreous envelope formed of soda-lime-silicate glass.

A further object of the invention is to provide an electrodeless lamp with a highly durable, external, EMI-suppressing conductive coating that can be formed with readily available means.

In summary, the invention provides an electrodeless, low pressure gas discharge lamp. The lamp includes a vitreous envelope containing a metal vapor and an inert gas. The envelope is shaped with an external chamber for receiving an electrical excitation circuit. The excitation circuit is effective for exciting the metal vapor to emit light with electromagnetic fields that are passed through the vitreous envelope from outside, to inside, the envelope. A circuit supplies electrical power from power mains to the excitation circuit. A transparent, electrically conductive coating is disposed on the inner surface of the vitreous envelope for suppressing electromagnetic interference on the power mains. An electrically conductive coating is disposed on the outer surface of the vitreous envelope; it is capacitively coupled to the inner conductive coating, via a wall of the vitreous envelope, and is maintained at a suitable potential for suppressing electromagnetic interference on the power mains. The outer conductive coating comprises a matrix of a contiguous, inorganic, glass layer bonded to an exterior surface of the vitreous envelope, and conductive particles embedded in the matrix in a sufficiently dense manner to form a conductive coating.

BRIEF DESCRIPTION OF THE DRAWING FIGURES

The foregoing, and further, objects and advantages of the invention will become apparent from the following description when read in conjunction with the accompanying drawing figures, in which.

DESCRIPTION OF THE PREFERRED EMBODIMENTS

Figure 1:
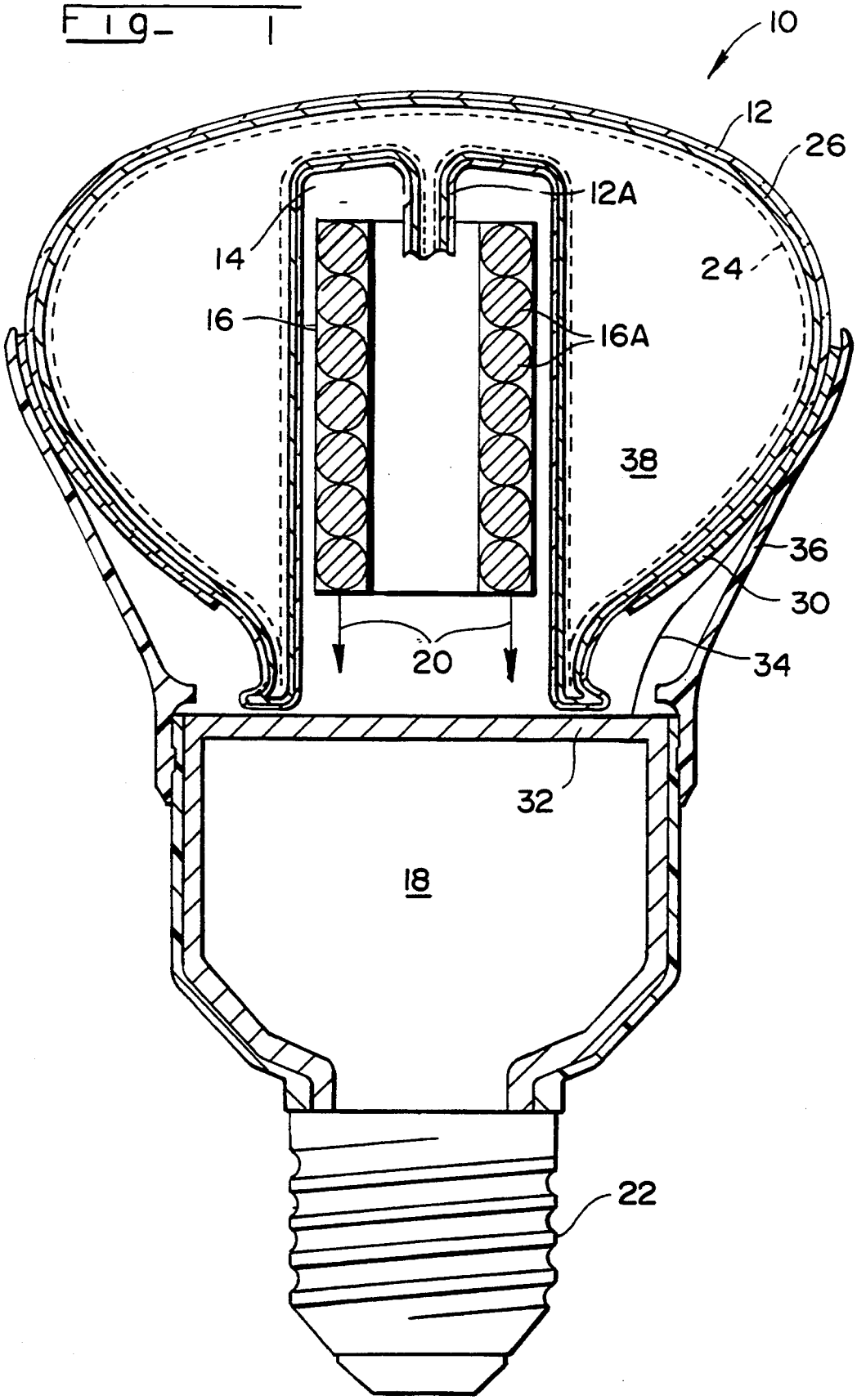
FIG. 1 is a simplified view of an electrodeless lamp, and is partially in cross section and partially cut away.

FIG. 1 is a simplified view of an electrodeless lamp 10 shown partially in cross section and partially cut away. Lamp 10 includes a vitreous envelope 12, such as soda-lime-silicate glass, that is hermetically sealed and that contains a metal vapor, such as mercury, and an inert gas such as argon. Vitreous envelope 12 is shaped with an external chamber 14 for receiving an electrical excitation coil 16. Coil 16 is shown with coil turns 16A whose cross sections are exaggerated in size. Coil 16 has a cylindrical shape, and a hollow interior through which stem 12A (shown partially cut away) of vitreous envelope 12 may extend. Coil 16 is electrically coupled to power supply, or ballast, circuit 18 via conductors 20, only part of which are shown; ballast circuit 18 is shown in schematic form as merely a block. Ballast circuit 18, in turn, is coupled to receive a.c. power from electrical supply mains via a screw-type base 22.

Excitation coil 16 generates high frequency electromagnetic fields for exciting the metal vapor within envelope 12 to produce light. The electromagnetic fields, thus, pass through the adjacent walls of envelope 12 to reach the metal vapor inside the envelope. Where mercury is employed within envelope 12, ultraviolet light is generated, which is then transformed into visible light through interaction with an interior coating system 24 that includes phosphor. Coating system 24 is shown as a dashed line.

The high frequency fields generated by excitation coil 16 can cause electromagnetic interference (EMI) on the power mains (not shown) that supply power to the lamp. In order to maintain such EMI within an acceptable range, the interior of vitreous envelope 12 is provided with a transparent, conductive coating 26, such as fluorine-doped tin oxide. Inner conductive coating 26 suppresses EMI on the power mains supplying the lamp; that is, it reduces such EMI to a tolerable level. In order for inner conductive coating 26 to fulfill its EMI-suppressing function, it needs to be maintained at a suitable potential within ballast circuit 18. Such potential may, for instance, be the negative voltage output of a full-wave rectifier (not shown) that rectifies a.c. voltage from power mains to a d.c. voltage. To couple ballast circuit 18 to inner conductive coating 26, a conductive coating 30 is formed on the exterior of vitreous enveloped 12. Outer conductive coating 30 has sufficient area to provide a relatively low impedance, capacitive connection to inner conductive coating 26.

Figure 2:
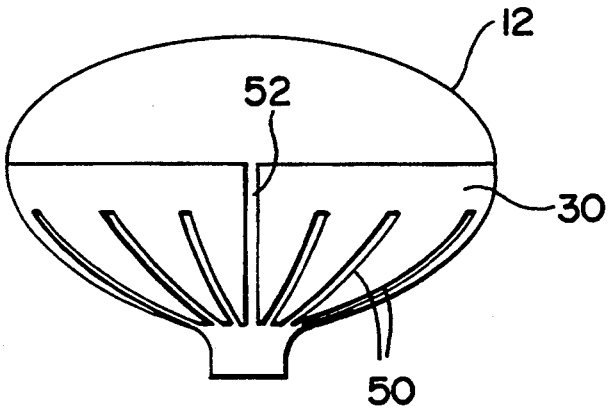
FIG. 2 is a side plan view of a vitreous envelope on which an external conductive coating is patterned with slits after being formed.

FIG. 2 shows outer conductive coating 30 in a typical pattern on vitreous envelope 12; after coating 30 has been formed on the envelope, slits 50 and 52 are formed, as discussed below. As shown in FIG. 1, a conductive shield 32 typically surrounds much of ballast circuit 18 for EMI-suppressing purposes. A conductor 34 then connects outer conductive coating 30 to conductive shield 32; the upper-shown portion of conductor 34 is suitably soldered to coating 30. A plastic skirt 36 beneficially provides a physical shield for outer conductive coating 30.

Figure 3:
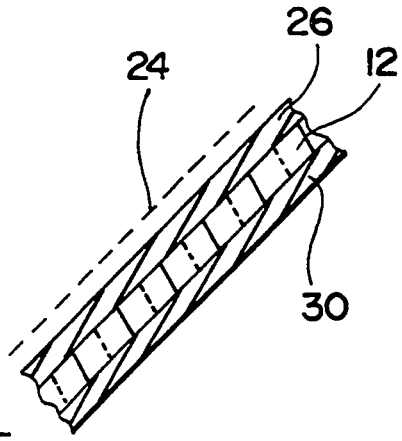
FIG. 3 is a detail view of a vitreous envelope and adjacent coatings taken in the vicinity of location 38 in FIG. 1.

FIG. 3 shows a detail view of vitreous envelope 12 and its various coatings in the vicinity of location 38 of FIG. 1. In FIG. 3, vitreous envelope 12 can be seen with outer conductive coating 30 and inner conductive coating 26. Vitreous envelope 12 itself serves as the dielectric for the mentioned capacitive coupling between the outer and inner conductive coatings. Coating system 24, in addition to including phosphor as mentioned above, typically also includes a reflecting coating for focusing light generally upwards as viewed in FIG. 1. The formation of vitreous envelope 12, inner conductive coating 26, and coating system 24 is suitably accomplished in a conventional manner. The present invention is particularly concerned, instead, with the formation of outer conductive coating 30.

As discussed in the "Background of the Invention" above, a suitable outer conductive coating, to fulfill its EMI-suppressing function over the expected life of a lamp, should retain adequate electrical conductivity and provide appropriate capacitive coupling to inner conductive coating 26. Thus, outer conductive coating 30 should exhibit adequate (1) resistance to abrasion, (2) resistance to a humid environment, (3) temperature tolerance (e.g. 160° C.), and (4) resistance to thermal shock and thermal cycling. The present inventors have tested a large number of conductive coatings for implementing outer conductive coating 30, finding them unable to meet the foregoing durability criteria. However, the present inventors have discovered that outer conductive coating 30 meets the durability criteria when comprised of a conductive enamel as specified below.

In particular, it has been found that coating 30 may be suitably formed by providing a mixture of glass frit and conductive particles suspended in an organic medium, for instance. The glass frit should have a lower softening temperature than vitreous envelope 12, should be temperature tolerant (e.g. 160° C.), and should have a coefficient of thermal expansion sufficiently close to that of vitreous envelope to be able to withstand the mentioned thermal shock and thermal cycling tests. Such mixture is applied to the exterior of vitreous envelope 12 in a desired pattern. The vitreous envelope and patterned mixture are then fired to remove the organic medium and cause the glass frit to fuse and form a contiguous, inorganic layer of glass. Such inorganic glass layer bonds to the exterior of vitreous envelope 12, while forming a matrix for securing the conductive particles. Meanwhile, the conductive particles become embedded in the glass matrix in a sufficiently dense manner to form a conductive layer.

Figure 4:
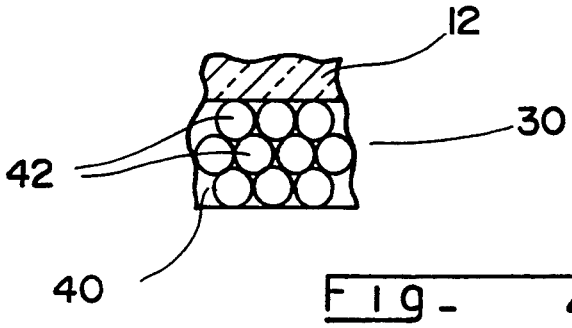
FIG. 4 is a cross-sectional view of a portion of a vitreous envelope with an outer conductive coating bonded thereto.

The thus-formed conductive coating 30 is schematically shown in FIG. 4. In FIG. 4, glass matrix 40 is shown as a contiguous glass layer that is bonded to vitreous envelope 12, and which forms a matrix for containing conductive particles 42. Conduction between adjacent conductive particles 42 may result from either mechanical contact between the particles, or possibly from a joining of the particles due to sintering that results from the mentioned firing operation for applying coating 30 to vitreous envelope 12.

It has been found that glass matrix 40 shields conductive particles 42 from both the external environment (e.g., humidity) and from vitreous envelope 12, as well as protecting the conductive particles from abrasion; thus, both durability tests (1) and (2) mentioned above are met. By choosing a glass frit to form glass matrix 40 with the temperature tolerance and thermal expansion characteristics mentioned above, the remaining durability criteria (3) and (4) are met.

The patterning of a non-fired mixture of glass frit and conductive particles suspended in an organic medium can be carried out in various ways. Such composition may be applied with a paint roller, or it may be thinned with a volatile solvent and brushed or sprayed on. Additionally, such unfired composition can be patterned on the envelope by gravure transfer printing, or by silk screening.

Referring again to FIG. 2, conductive coating 30, after being fired onto vitreous envelope 12, is typically further patterned by forming a plurality of partial slits 50 and a full slit 52 in the coating. Such slits are areas where conductive coating 30 has been fully removed. The purpose of these slits is to reduce potentially harmful eddy currents that are generated from electromagnetic fields produced by excitation coil 16 of FIG. 1. The slits are typically between 1 and 2 millimeters in width. A vitreous envelope 12 having a maximum horizontal diameter as shown in FIG. 2 of about 8 centimeters will typically employ 12 slits 50 and 52. Further details of such slits are contained in co-pending, U.S. patent application Ser. No. 08/228,979 entitled "External Metallization Configuration for an Electrodeless Lamp," by L. R. Nerone and J. D. Mieskoski, filed on Apr. 18, 1994. The foregoing application is assigned to the present assignee, and its entire disclosure is incorporated herein by reference.

In one example of preparing a conductive enamel, a vitreous envelope 12 comprising soda-lime-silicate glass was used. The soda-lime-silicate glass has typical weight composition ranges as follows: $SiO_2$, 65–75%; $Na_2O$, 12–20%; CaO, 4–6%; MgO, 3–4%; $Al_2O_3$, 0.3–2%; $K_2O_3$, 0.3–2%; and $Fe_2O_3$, 0.02–0.06%. Such glass is available, for instance, from the General Electric Company of Cleveland, Ohio under the product designation GE-008, or from Coming Glass Works, Inc. of Coming, N.Y. under the product designation Corning-0080. In forming conductive layer 30, a mixture of lead-borosilicate glass frit and silver particles suspended in an organic medium was provided; such a mixture is available from DuPont de Nemours and Co., Inc. of Wilmington, Del., as screen print ink no. 7713. The mixture was patterned on vitreous envelope 12 with a paint roller, and the so-coated envelope was fired for about 5 minutes at a temperature of approximately 500° C. in an oxidizing environment. Mixtures containing other conductive particles, however, such as copper, would expectedly need a non-oxidizing (i.e., inert) firing environment. By way of example, further conductive particles that may be contained in the mentioned mixture comprise platinum, palladium, molybdenum or nickel.

From the foregoing, it will be appreciated that the present invention provides an electrodeless lamp with an outer, EMI-suppressing conductive coating that is highly durable, especially where a vitreous envelope of such lamp is comprised of soda-lime-silicate glass. The outer, EMI-suppressing conductive coating, further, can be formed with readily available means.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. An electrodeless, low pressure gas discharge lamp, comprising:

(a) a vitreous envelope containing a metal vapor and an inert gas, said envelope being shaped with an external chamber for receiving an electrical excitation circuit;

(b) said excitation circuit being received in said external chamber of said envelope and being effective for exciting said metal vapor to emit light with electromagnetic fields that are passed through said vitreous envelope from outside, to inside, said envelope;

(c) a circuit for supplying electrical power from power mains to said excitation circuit;

(d) a transparent, electrically conductive inner coating disposed on the inner surface of said vitreous envelope for suppressing electromagnetic interference on said power mains; and (e) an electrically conductive outer coating on the outer surface of said vitreous envelope that is capacitively coupled to said inner coating, via a wall of said vitreous envelope, and that is maintained at a suitable potential for suppressing electromagnetic interference on said power mains;

(f) said outer coating comprising a matrix of a contiguous, inorganic, glass layer bonded to an exterior surface of said vitreous envelope, and conductive particles embedded in said matrix in a sufficiently dense manner to form a conductive coating.

2. The gas discharge lamp of claim 1, wherein said glass layer of said outer conductive coating comprises lead-borosilicate glass.

3. The gas discharge lamp of claim 1, wherein said conductive particles comprise one of the group consisting of silver, copper, platinum, palladium, molybdenum and nickel.

4. An electrodeless, low pressure gas discharge lamp, comprising:

(a) a vitreous envelope containing a metal vapor and an inert gas, said vitreous envelope comprising soda-lime-silicate glass and being shaped with an external chamber for receiving an electrical excitation circuit;

(b) said excitation circuit being received in said external chamber of said envelope and being effective for exciting said metal vapor to emit light with electromagnetic fields that are passed through said vitreous envelope from outside, to inside, said envelope;

(c) a circuit for supplying electrical power from power mains to said excitation circuit;

(d) a transparent, electrically conductive inner coating disposed on the inner surface of said vitreous envelope for suppressing electromagnetic interference on said power mains; and (e) an electrically conductive outer coating on the outer surface of said vitreous envelope that is capacitively coupled to said inner coating, via a wall of said vitreous envelope, and that is maintained at a suitable potential for suppressing electromagnetic interference on said power mains;

(f) said outer coating comprising a matrix of a contiguous, inorganic, glass layer bonded to an exterior surface of said vitreous envelope, and conductive particles embedded in said matrix in a sufficiently dense manner to form a conductive coating.

5. The gas discharge lamp of claim 4, wherein said glass layer of said outer conductive coating comprises lead-borosilicate glass.

6. The gas discharge lamp of claim 4, wherein said conductive particles comprise one of the group consisting of silver, copper, platinum, palladium, molybdenum and nickel.

7. The gas discharge lamp of claim 4, wherein:

(a) said glass layer of said outer conductive coating comprises lead-borosilicate glass; and (b) said conductive particles comprise one of the group consisting of silver, copper, platinum, palladium, molybdenum and nickel.

* * * * *